US006146317A

United States Patent [19]

Prusick

[11] Patent Number: 6,146,317

[45] **Date of Patent: *Nov. 14, 2000**

[54] EXERCISING DEVICE

[76] Inventor: Vincent R. Prusick, 10517 SW. Bay Shore Dr., Traverse City, Mich. 49684

[ * ] Notice: This patent is subject to a terminal disclaimer.

[21] Appl. No.: 09/045,004

[22] Filed: Mar. 20, 1998

Related U.S. Application Data

[63] Continuation-in-part of application No. 08/623,136, Mar. 28, 1996, Pat. No. 5,730,688.

[51] Int. Cl.[7] ..... A63B 21/04; B60N 2/02

[52] U.S. Cl. ..... 482/130; 482/142; 482/140

[58] Field of Search ..... 482/130, 140, 482/10, 121, 122, 123, 129, 133, 142; 297/353, 296, 297, 298; 601/24

[56] References Cited

U.S. PATENT DOCUMENTS

| | | | |
|---|---|---|---|
| 3,059,971 | 10/1962 | Becker | 297/353 |
| 5,112,106 | 5/1992 | Asbjornsen | 297/353 X |
| 5,141,482 | 8/1992 | Hern | 482/130 |
| 5,256,126 | 10/1993 | Grotstein | 482/142 |
| 5,288,130 | 2/1994 | Foster | 297/353 X |
| 5,545,114 | 8/1996 | Gvoich | 482/140 |
| 5,599,261 | 2/1997 | Easley | 482/130 |
| 5,665,041 | 9/1997 | Hsieh | 482/140 |
| 5,702,334 | 12/1997 | Lee | 482/140 |
| 5,730,688 | 3/1998 | Prusick | 482/130 |
| 5,769,766 | 6/1998 | Huang | 482/140 |
| 5,792,035 | 8/1998 | Ward | 482/140 |
| 5,807,220 | 9/1998 | Allis | 482/140 |

FOREIGN PATENT DOCUMENTS

| | | | |
|---|---|---|---|
| 2324324 | 4/1977 | France | 482/142 |
| 515802 | 1/1931 | Germany | 297/353 |

*Primary Examiner*—Jerome Donnelly
*Attorney, Agent, or Firm*—Douglas S. Bishop

[57] ABSTRACT

An exercise device for use in exercising and strengthening abdominal and lower back muscles. The device is easily utilized, may be readily disassembled, and is easily portable. The device utilizes individual upright resilient bars of varying degrees of resistance which may be interchangeably affixed to a seat portion of the device. The upper portion of the resilient bar feature, which may be bowed in one direction, has an attached padded upper body support on one side and a harness element on the other. The user may sit on the seat element and exert backward pressure against the upper back support to exercise lumber (extensor) paraspinal muscles of the lower back, or the user may sit on the seat element gripping a handlebar assembly affixed to the upper end of the resilient bar and bend forwardly exerting pressure away from the bar to exercise the abdominal muscles. A padded lower back support is provided to assist in properly positioning the user on the device.

24 Claims, 6 Drawing Sheets

EXERCISING DEVICE

STATUS OF APPLICATION

This is a continuation-in-part from application Ser. No. 08/623,136, originally filed Mar. 28, 1996, now U.S. Pat. No. 5,730,688.

BACKGROUND OF THE INVENTION

This invention relates to exercising devices and, more specifically, to a device primarily directed to the human torso and exercise of the abdominal and lumbar (extensor) paraspinal muscles of the lower back.

The concept of resistance for exercising individual muscles or muscle groups is generally known. Various techniques, such as "sit ups", abdominal "crunches", "push-ups" and "pull-ups" utilize the weight or resistance of the body itself to provide such benefit. Free weights, in the form of barbells and dumbbells have long used for such purposes. Likewise, various weight training or resistance devices have been developed for such purposes. U.S. Pat. No. 4,372,553, to Hatfield, discloses a weightlifting device and method of exercise utilizing a shoulder harness, seat, and weight pulley attachment, to utilize the abdominal muscles in moving a designated weight in a vertical direction. U.S. Pat. No. 4,582,319, issued to Luna, discloses a sit-up exercise bench which utilizes a shoulder harness, bench, and spring resistance in which the user performs sit-up-like exercises but with a greater degree of resistance. U.S. Pat. No. 5,141,482, issued to Hern, discloses an exercising device for utilization with a straightback seat utilizing a shoulder harness and pair of adjustable length shoulder straps which inhibit downward motion when the exerciser moves forwardly against the tension of the cords and tightens the stomach muscles when performing such an exercise. U.S. Pat. No. 5,094,450, issued to Stearns, discloses an abdominal exercise machine in which pressure is applied through the user's chest to a chest pad with resistance provided by a viscous fluid resistance cylinder, or by stacked weights. U.S. Pat. No. 1,969,901 discloses an exercise chair with resistance in the chair provided by a spring mechanism. U.S. Pat. No. 1,973,945, issued to M. I. Chavin et al discloses a combination exercising and massaging apparatus with resistance therein provided by various spring mechanisms. U.S. Pat. No. 5,135,445, issued to Christensen et al, discloses an exercising device for the neck which may be mounted on a standard door and provides resistance through a suspended generally U-shaped leaf spring member.

Further, clinical medical studies have demonstrated the effectiveness of mechanically-aided exercise in situations where the pelvis is fixed in a position which allows the person's back or spine to be exercised both in flexion and in extension. Devices for such purposes, include lumbar extension machines and torso rotation machines, both by MedX Corporation of Ocala, Fla. Such machines are extremely complex. While very effective, their complexity, size and expense does not render them ready susceptible to individual purchase and use, or for portable applications.

While all of the referenced prior art relates, in some respect, to exercise of certain muscle groups by providing a means of resistance to movement through a certain range of motion, such inventions are directed primarily toward one particular muscle group and are further directed to resistance to either a pushing type of muscle motion as in the Christensen, et al patent, or a pulling resistance mechanism which seems to have found particular favor in devices relating to abdominal muscle groups such as demonstrated in the patents issued to Luna, Hatfield and Hern.

While all of the referenced prior art relates, in some manner, to exercise or therapy of particular muscles or muscle groups, for the most part, such devices are extremely limited in that their application is generally limited to one particular muscle group, or they are directed to devices which are inordinately complicated and, often, extremely expensive. The referenced prior art is not directed to a simplistic, portable device which may be interchangeably used to exercise the abdominal and lower back muscle groups of the human torso.

Exercise of these muscle groups has become particularly important in the rehabilitation of back injuries and in physical therapy designed to promote recovery and to prevent recurrence. Machines typically utilized for these purposes are, for the most part, extremely expensive and usually available only in rehabilitation centers, medical facilities and health clubs. The expense of such machines does not often render them economically feasible for individual use outside of those settings. Even if such machines are within the economic reach of a person in need, they are typically large, heavy and cumbersome, and not easily or economically transportable for use when traveling, or otherwise away from home for any period of time.

The concept of a resilient member for providing resistance is also known. Although the above-disclosed prior art does not make mention of it, the utilization of molding or laminated fiberglass "limbs" as components of bows is well known in the archery industry. U.S. Pat. No. 3,993,039, issued to Groves et al, discloses a compound archer bow utilizing flexibly resistent bow limbs. U.S. Pat. No. 4,201,177, issued to Holman et al, likewise discloses a compound bow utilizing the opposite flexible limbs. Another example of such prior art is U.S. Pat. No. 4,593,674, issued to Kudlacek, which specifically references flexure of opposing limbs of the bows structure. Although no one in the archery industry, however, none of the referenced prior art relative to exercising devices incorporates the limb structure expressly referenced in the archery-related patents.

Accordingly, a need exists for an exercising device capable of providing resistance training for the lower back and abdominal muscle groups of the human torso, which device is portable, easily assembled and operated by one person and relatively inexpensive to purchase and maintain. Specifically, what is needed is a device which may be used interchangeably to exercise both the lower back and abdominal muscles, which is lightweight, easily disassembled and easily carried, and which provides a minimum of moving parts for safety considerations and ease of maintenance.

SUMMARY OF THE INVENTION

This invention is directed to the provision of an exercising device that is specifically directed to the human torso and exercise of the abdominal and lumbar (extensor) paraspinal muscles of the lower back. More specifically, this invention is directed to the provision of a torso exercising device which may be utilized interchangeably to exercise both the lower back and abdominal muscles.

A more specific object of the invention is to provide such an exercising device which does not require the use of weights, cables, or resistance springs, and which is relatively simple in construction, operation and assembly. The invention exercising device is of a type including a seat defining a generally horizontal seating surface, utilizing a resilient upright member extending upwardly from the rear of the seating surface to provide exercising resistance for the lower back when pressure is exerted against it by the user's upper back and resistance to the abdominal muscles when pressure is exerted forward from the support. According to an important feature of the invention, the resilient upright member may be constructed of molded or laminated fiberglass such as is commonly used for bow limbs in the archery industry.

According to a further feature of the invention, the upright resilient member has a padded contact member at its upper end, and a padded contact member at its lower end. This arrangement allows the person utilizing the exercising device to sit on the seating member, positioned so that the user's lower back contacts the lower back pad and the user's upper back contacts the upper back pad in an appropriate position to exert exercising pressure against upright member through the upper back pad.

According to a further feature of the invention, the resilient upright member may be bowed so that the concave dimension of the bowed member is toward the forward edge of the seat. This arrangement allows the user a fuller range of motion when exerting pressure rearwardly against the upper back support.

According to a further feature of the invention, a handlebar assembly may be affixed to the upper portion of the resilient member, with the handle portions thereof, protruding forwardly, away from the resilient member, toward the forward edge of the seat member. This further feature allows the user to exert pressure away from the resilient member when the user tilts or bends forwardly on the device, in a seated position. When a bowed feature is included with the resilient member, the concave dimension of the bowed member may be positioned away from the back of the user to allow the user a fuller range of motion in bending forward and exerting pressure, through the handlebar attachment, against the resistence offered by the resilient member.

According to a further feature of the invention, the upper back pad and the handlebar member may be mounted on opposite sides of the resilient member and a means provided to allow the resilient member to be reversed to alternatively provide resistence for exercising the abdominal muscles and for exercising the lower back muscles. This arrangement allows the handlebar member to be placed in the side comprising the convex dimension of the bow of the resilient member and the upper back pad replaced on the side of the resilient member comprising the concave dimension.

According to a further feature of the invention, a harness may be affixed to the upper portion of the resilient member and fastened about the chest of the user, to allow the user to exert pressure away from the resilient member when the user tilts or bends forwardly on the device in a seating position. When a bowed feature is included with the resilient member, the concave dimension of the bowed member may be positioned away from the back of the user, to allow the user a fuller range of motion in bending forward and exerting pressure against the resistance offered by the resilient member.

According to a further feature of the invention, the upper back pad and harness member may be mounted on opposite sides of the resilient member and a means provided to allow the resilient member to be reversed to alternatively provide resistance for exercising the abdominal muscles and for exercising the lower back muscles. This arrangement allows the harness member to be placed on the side comprising the convex dimension of the bow of the resilient member and the upper back pad to be placed on the side of the resilient member comprising the concave dimension.

According to a further feature of the invention, the upright resilient member may be attached to the seating member component by utilization of a hollow support member permanently affixed to the seat component of the invention. The hollow support member has an interior dimension sufficiently sized to accept the lower end of the resilient member in a male-female relationship. This arrangement allows the resilient member to be easily removed from the device for storage and/or transportation. It also provides for reversal to allow ready alternative use of the device for the abdominal and lower back muscles, and replacement of alternative resilient members, when they are utilized.

According to a further feature of the invention, a number of resilient members of varying degrees of exercising resistance may be provided which may be used interchangeably on the device in order to provide varying degrees of resistance to be chosen by the user in exercising. Such a feature allows the user to increase or decrease resistance depending on the number of repetitions to be performed, and to adjust as the user adapts, through exercise, to the resistance being utilized. It also allows the user to utilize different degrees of resistance for exercising the abdominal muscles as opposed to the lower back muscles, which are distinct and separate muscle groups.

According to a further feature of the invention, the resilient member contains a number of apertures or holes vertically aligned at different distances from its lower end or base. The hollow support member likewise contains one or more holes or apertures placed so as to be vertically aligned with the holes of the resilient member when the resilient member is in place, in a malefemale relationship, within the hollow support member. A cotter pin, or like member, is utilized by inserting such pin through the holes in the support member and a selected hole in the resilient member to position the base of the resilient member and, accordingly, the upper end of the resilient member, at a desired vertical distance above the seating member. This arrangement allows the upper back pad or harness member to be positioned at a sufficient vertical height above the seat member to accommodate varying physical stature of the users.

According to a further feature of the invention, the lower back pad may be affixed permanently to the side of the hollow support member facing the forward edge of the seat member, to allow the user to be positioned snugly against the back of the seating member to assure proper position for utilization of the device.

According to a further feature of the invention, the seating member, as well as the upper and lower back members, is covered with a padding material. This arrangement allows maximum comfort for the user when sitting on the device and when exerting pressure against the lower and upper back members.

According to a further feature of the invention, the harness member attached to the upper end of the resilient upright, which provides the exercising resistent, may be enclosed within a housing or storage pack for convenient storage when the abdominal exercising function of the device is not being utilized. This housing, or storage pack, may be secured by means of a zipper, velcro, or other fastening device.

According to a further feature of the invention, a strap or belt member is attached to, or around, the seat member. The strap or belt member has two separate end portions removabeably fastened together and means to adjust them to firmly hold the user's upper legs to the seating member, with the user's back against the lower back pad to hold the pelvis in fixed position while allowing the user's back or spine to be exercised both in flexion and in extension.

According to a further feature of the invention, the two end portions of the strap or belt element may be removably attached by buckle, velcro or other fastening device.

It is a further feature of the invention that it may be constructed of lightweight materials, such as fiberglass, and easily disassembled and carried, to allow use by user, in the home, in the office, and while traveling.

According to a further feature of the invention, the entire device may be constructed entirely of molded fiberglass.

The above and additional features of the invention may be considered and will become apparent in conjunction with the drawings, in particular, and in the detailed description which follows.

DETAILED DESCRIPTION OF THE PREFERRED EMBODIMENT

Figure 1:
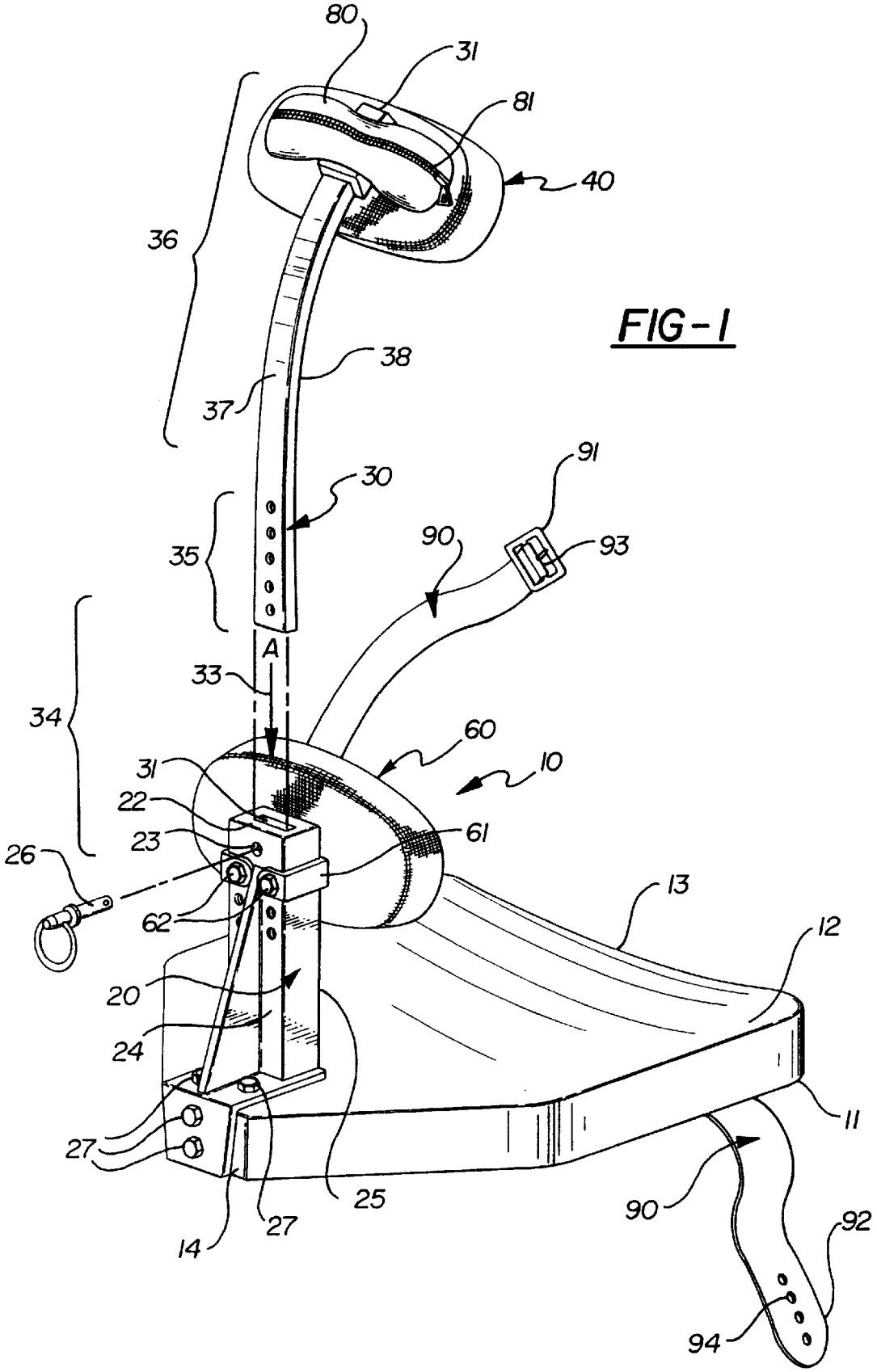
FIG. 1 is an exploded perspective view of a preferred embodiment of the exercising device showing the elongated resilient member and its male to female relationship with the hollow upright support member which is affixed to the base seating member of the invention.

The invention exercising device 10, broadly considered, includes a base seating member 11 which defines a generally horizontal seating surface 12. The base seating member 11 has a forward edge 13 and a rearward edge 14. Attached to the seating member 11 at its rearward edge 14 is a support stanchion 20. In the preferred embodiment of the invention the support stanchion 20 is hollow with an opening 21 in its upper surface 22. The support stanchion 20 also defines an aperture or hole 23 extending through the stanchion 20 through its rearward side 24 to its forward side 25. A removable cotter pin 26 fits within the aperture or hole 23. In a preferred embodiment of the invention 10, the support stanchion 20 is affixed to the base seating member 11 by a plurality of fasteners 27 which may be bolts, screws, rivets or the like, but which are not limited to a particular device. The exercising device 10 further includes an upright, flexible, resilient member 30. Resilient, in this context, means a member such as found in a laminated or molded archery bow limb, or leaf spring-type element which may be flexed while providing resistance throughout the range of the flexing motion. Resilient member 30 has an upper end 31 and a lower end 32. Resilient member 30 extends generally upwardly from seating member 11, with its lower end 32 affixed to seating member 11. In a preferred embodiment of the invention, lower end 32 of resilient member 30 is inserted in a downward direction 33 into the opening 21 in the upper surface 22 of hollow support stanchion 20. Opening 21 is of sufficient interior dimension to accept the lower end 32 of the resilient member 30 in a male-female relationship 34. Such male-female relationship 34 between resilient member 30 and support stanchion 20 thereby affixing resilient member 30 to seating member 11.

In a further preferred embodiment of the invention 10, resilient member 30 at its lower end 32 contains a series of apertures 35 vertically aligned AA with aperture or hole 23 in the hollow support stanchion 20. The pin 26 is removed from the hollow support member 20, while the resilient member 30 is positioned within the opening 21 of hollow support member 20 in the stated male-female relationship 34. The aperture or hole 23 is aligned with one of the series of apertures 35. The pin is then inserted through both support stanchions 20 and resilient member 30 to fix resilient member 30 at defined vertical distance above seating member 11.

In a further preferred embodiment of the invention 10, resilient member 30 is bowed 36 to provide a convex side 37 and concave side 38. In the embodiment shown in FIG. 1, the convex side 37 corresponds with the rearward edge 14 of seat member 11 and the concave side 38 corresponds with the forward edge 13 of seat member 11.

In a further embodiment of the invention 10, where the resilient member 30 is bowed 36, the lower end 32 of the resilient member 30 may be reversibly inserted in opening 21 of the hollow support stanchion 20 so that the convex side 37 faces in the direction of forward edge 13 and the concave side 38 faces in the direction of rearward edge 14, or vice versa.

Figure 3:
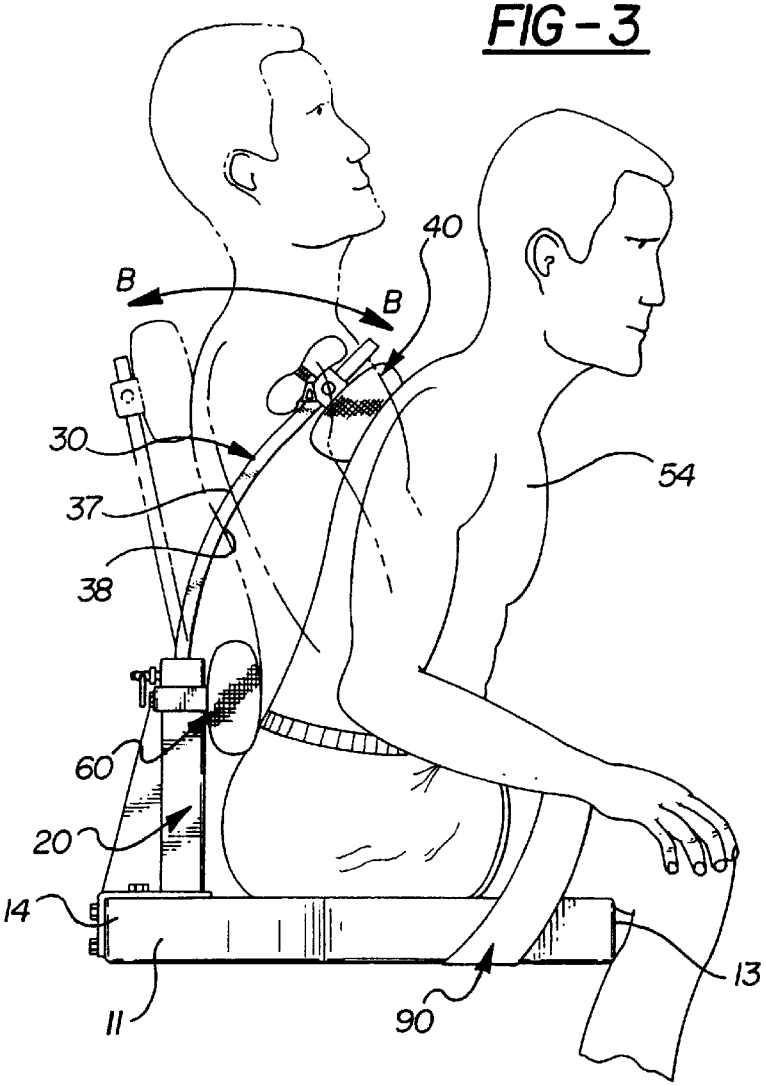
FIG. 3 is a side transitional view of the invention being utilized to exercise the lumber (extensor) paraspinal muscles of the lower back.

In a preferred embodiment of the invention 10 an upper back contact member 40 is affixed to the upper end 31 of the resilient member 30. The user 50 contacts the upper back contact member 40 at a point between the shoulders 51 of the user 50 and exert pressure against resilient member 30 through the upper back support member 40, moving the resilient member 30 resistantly through a range of motion BB as shown in FIG. 3. When utilized with a bowed 36 resilient member 30, the upper back support member 40 is placed on concave side 38 of the resilient member.

In a further preferred embodiment of the invention 10, a lower back support 60 is provided. It is attached directly forward of the lower end 32 of the resilient member 30 and may be attached directly to the forward side 25 of the support stanchion 20. This attachment may be by means of a bracket 61 held in place by fasteners 62, which may include bolts, screws, rivets or the like, but not limited to a particular device.

Figure 5:
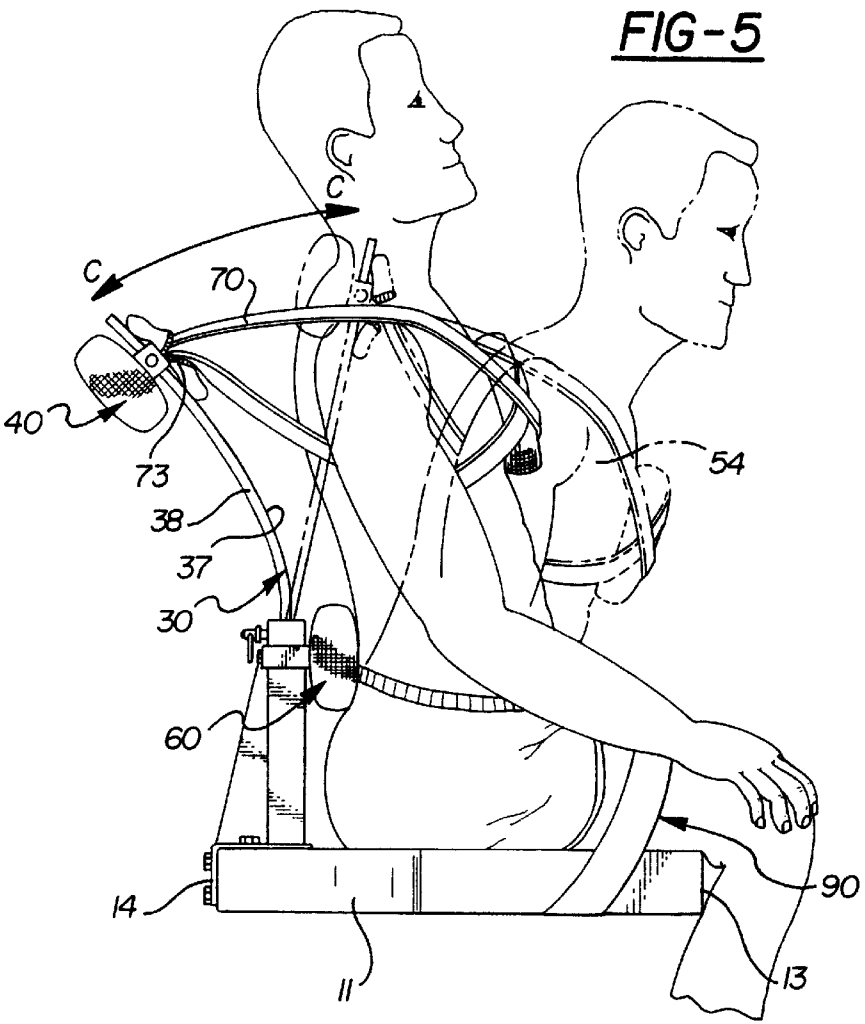
FIG. 5 is a side transitional view of the invention being utilized to exercise the abdominal muscles.

In a further embodiment of the invention a harness assembly 70 is provided, attached to the upper end 31 of the resilient member 30. The harness assembly 70 has two or more strap elements 71 and 72 which are removably attached to the resilient member 30 at two ends which strap elements 71 and 72 have adjustable means, such as buckles 74 for closely fitting each strap element 71 and 72 above the chest 54 of the user 50. When used in conjunction with a bowed 36 resilient member 30, said harness assembly 70 is attached to the convex side 37 of the resilient member 30. FIG. 5 demonstrates a range of motion CC of the resilient member 30, by a user 50 utilizing the harness 70.

Figure 2:
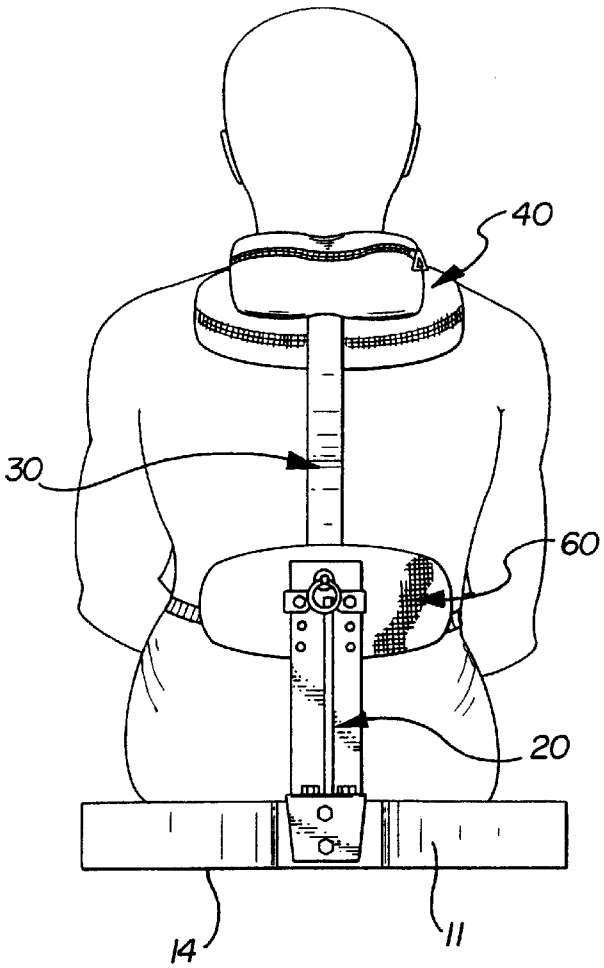
FIG. 2 is a back perspective view of a preferred embodiment of the exercising device showing the device in operation and the position of the upper back support member and lower back support member.

FIG. 2 demonstrates a user 50 seated on the seating member 11, with correct contact of the upper back contact member 40 and the lower back contact member 60.

Figure 4:
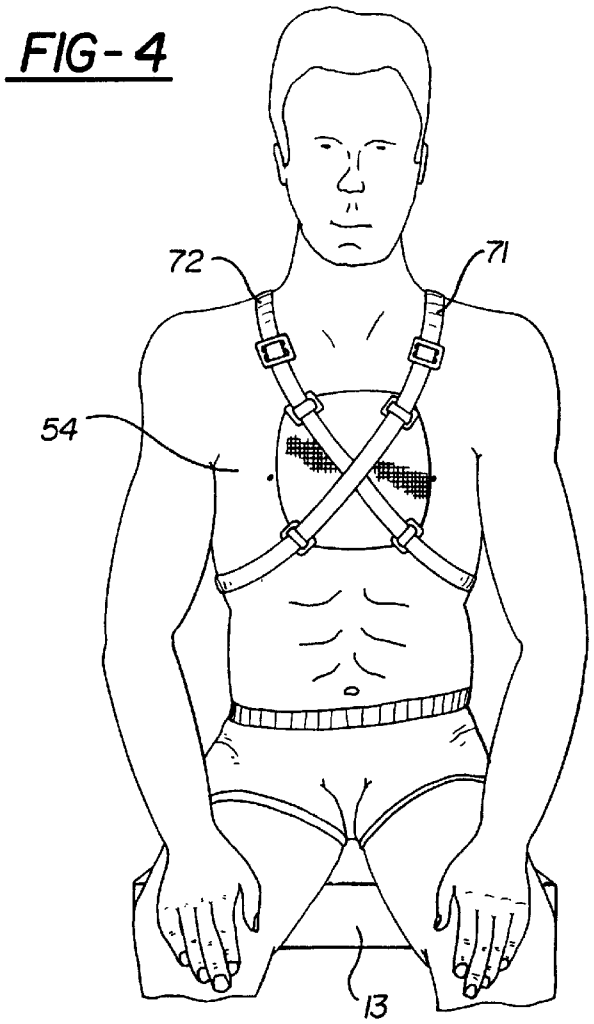
FIG. 4 is a front perspective view of a person utilizing the device to exercise the abdominal muscles showing the elongated harness element in place.

FIG. 4 demonstrates a user 50 seated on the seating element 11 with the harness assembly 70 strap elements 71 and 72 adjusted about the user's 50 chest 54.

Figure 6:
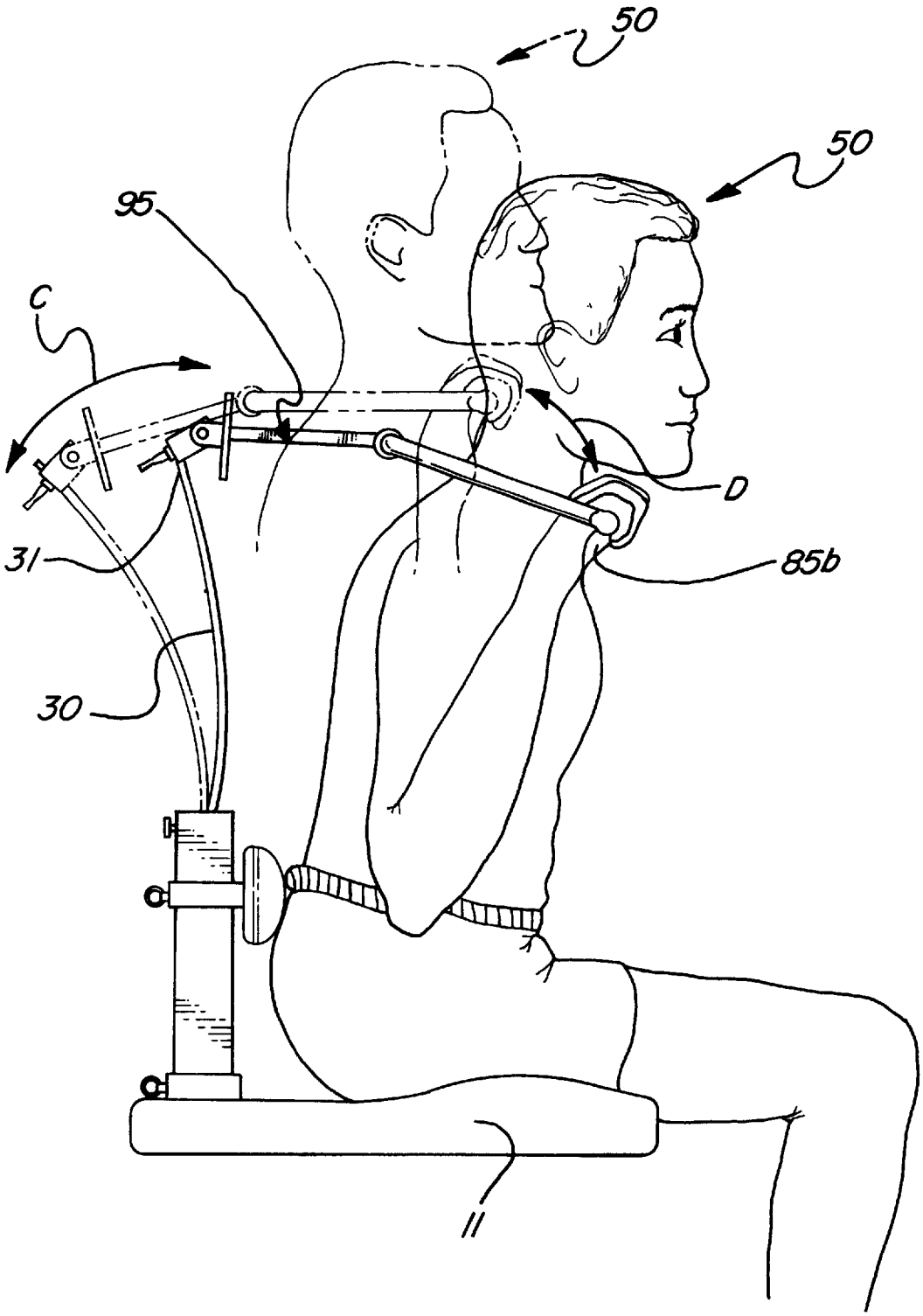
FIG. 6 is a side transitional view of a person utilizing the device to exercise the abdominal muscles showing the handlebar assembly, in place.
Figure 7:
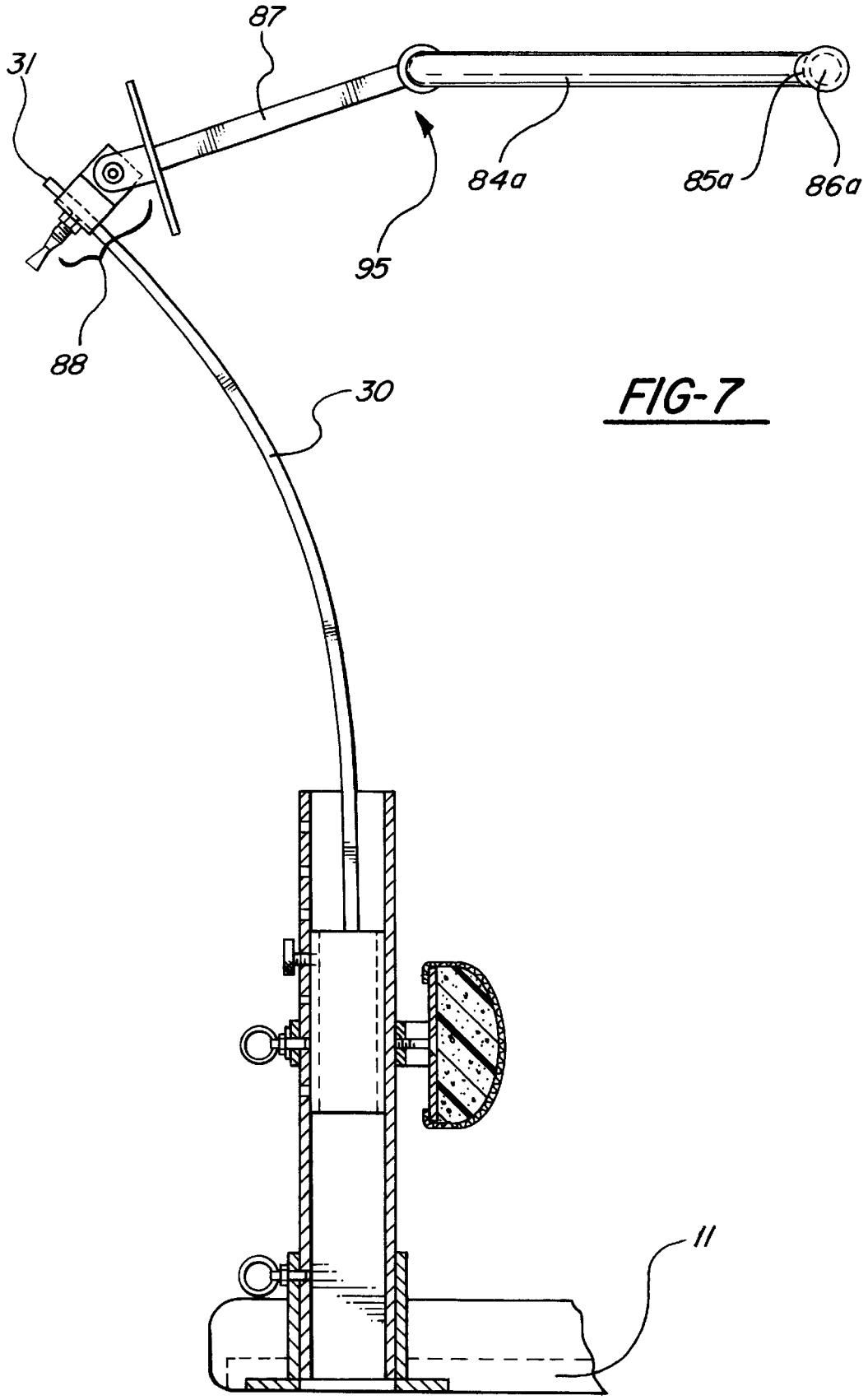
FIG. 7 is a side perspective view of a preferred embodiment of the exercising device showing the handlebar assembly in place.
Figure 8:
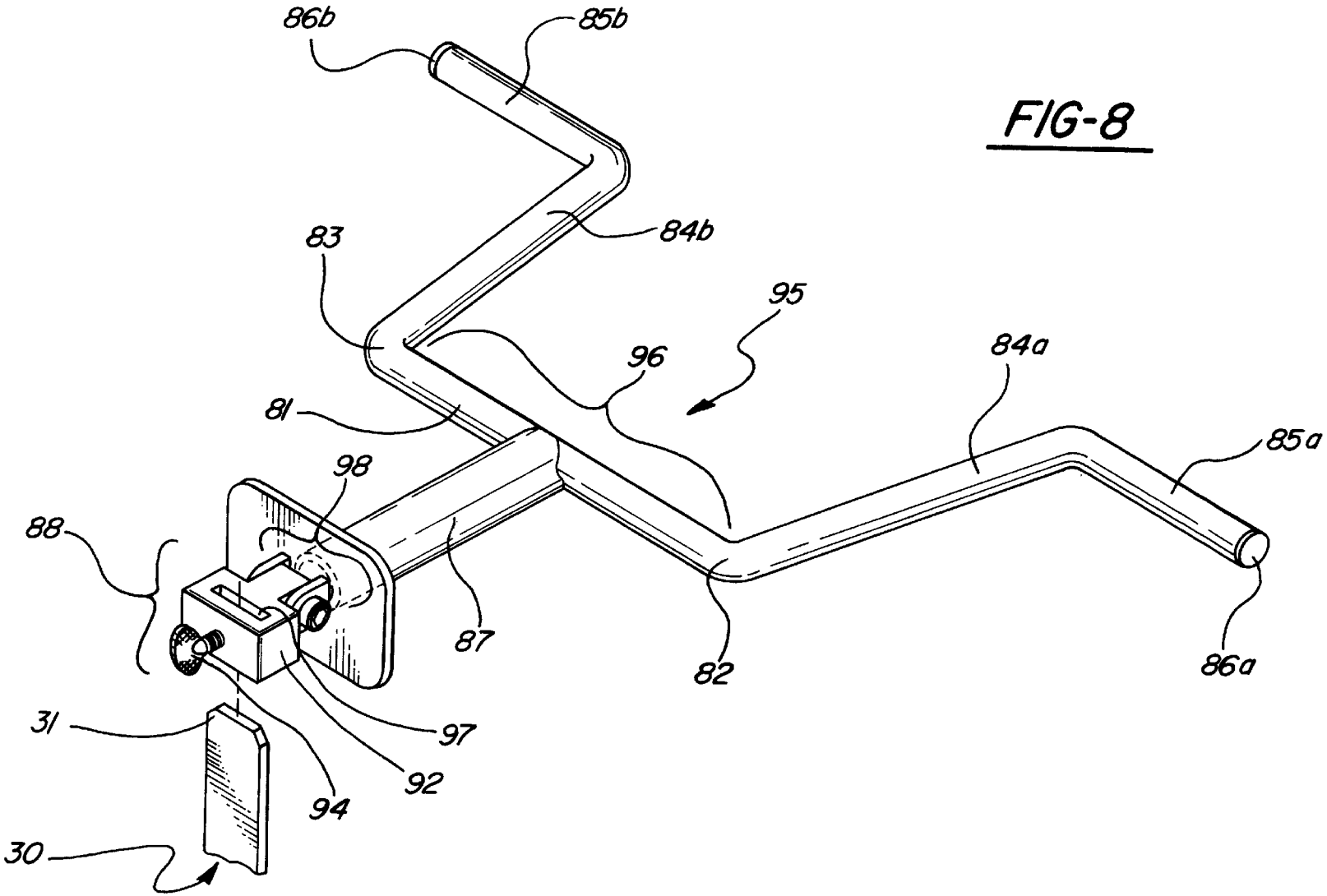
FIG. 8 is a perspective view of the handlebar assembly of the invention showing its relationship with the elongated resilient member.

FIG. 6 demonstrates a user 50 seated on the seating element 11 with handlebar assembly 80 in place demonstrating a range of motion CC.

In a further embodiment of the invention 10, a handle bar assembly 95, attached to the upper end 31 of the resilient member 30. The handle bar assembly 95 has a primary bar element 81 having a length dimension 96. Primary bar element 81 has a first end 82 and a second end 83. Extending from the primary bar element 81 at ends 82 and 83 are a pair of members 84*a* and 84*b* which extend generally forwardly in a corresponding manner, and having outward ends 86*a* and 86*b*. At outwardly extending end 86A and 86*b* are a pair of corresponding handle attachments 85*a* and 85*b*. Handle attachment 85*a* is affixed at end 86*a* and handle attachment 85*b* is affixed at end 86*b*. A connecting member 87 extends rearwardly from the primary bar member 81 and is affixed to the primary resilient member 30 at its upper end 31. A connecting means 88 is provided. In the preferred embodiment, this connecting means 88 may be a slot 97 defined by and contained within an extension 92 of the connecting member 87. Slot 97 is configured to accept the upper end 31 of resilient member 30 in a male/female relationship. In the preferred embodiment, the connecting means 88 includes a hinge element 98 to allow the handlebar attachment 95 to move in range of motion DD while the resilient member 30 moves through range of motion CC. As shown in FIG. 6, the user 50 grips the handle members 85*a* and 85*b* and moves the device 10 through ranges of motion CC and DD. The hinge element 98 may be any type of hinge which will allow the range of motion DD.

A locking screw 94 is provided to hold the handle bar attachment 95 in place on the resilient member 30.

In a further preferred embodiment of the invention 10, a case or housing 80 is attached to the upper end 31 of the resilient member 30 to house or store the harness assembly 70 when the harness assembly 70 is not being used. The case or housing 80 may be closed by means of a zipper attachment 81, velcro, or other fastening means.

In a further preferred embodiment of the invention 10, the upper back contact member 40, the lower back contact member 60, and the seat element 11, may be covered with a padded material for comfort of the user 50.

In a further embodiment of the invention 10, a strap element 90 is attached to the seat element 11. Said strap element 90 has opposing ends 91 and 92. A buckle or other adjustable fastening means 93 is affixed interchangeably to either end 91 or 92. The opposing alternative end 91 or 92 has fastening means 94 to correspond with fastening means 93. In the embodiment shown, such adjustable means 93 and 94 comprise a buckle as means 93 and a series of perforations as corresponding means 94. Alternative adjustable means could include corresponding velcro-type components on corresponding ends 91 and 92 or other generally known adjustable fastening means.

In the preferred embodiment of the invention, the resilient member 30 may be constructed so as to provide a specified resilient resistance. The invention 10 may be provided with interchangeable and separate resilient members 30, each with a different degree of resilient resistence. The resilient member 30 would, in the preferred embodiment, have a resistence within a range of less than 10 pounds minimum resilient resistance to 200 or more pounds maximum resilient resistence. The resilient member 30, in the preferred embodiment, through range of motion BB and range of motion CC, is configured to undergo an excursion of at least 30° from its static, or substantially vertical position. Said resilient member 30 is designed to maintain its resilient resistance through the entire excursion. In the preferred embodiment of the invention, a 30° angular change from the vertical, through range of motion CC, and range of motion BB, will provide an excursion of the primary resilient member 30 equal to approximately 8 or more linear inches. In the preferred embodiment, the resilient member provides resistence to the excursion movement, together with continuing resilient resistence, thus providing resistence throughout the entire extension through the excursion, and back to the original position.

WHEREAS, a preferred embodiment of the invention has been illustrated and described in detail, it will become apparent that various changes may be made in the disclosed embodiment without departing from the spirit of the invention.

What is claimed is:

1. An exercising device comprising a base seating member having a forward edge and a rearward edge an elongated resilient member having a lower end and an upper end, extending generally upwardly from the rearward edge of said base seating member, a means for affixing the lower end of said elongated resilient member to the rearward edge of said base seating member, and a handlebar assembly affixed to the upper end of said elongated resilient member.

2. An exercising device according to claim 1, wherein said handlebar assembly further comprises a primary bar member having a length dimension and a first end and second end; a pair of corresponding members forwardly extending from the first end and second end of said primary bar member; a pair of handle members each affixed to one of the forwardly extending members; a connecting member extending rearwardly from said primary bar member; and a means of affixing said connecting member to the elongated resilient member.

3. An exercising device according to claim 1, wherein the means for affixing said elongated resilient member to said base seating member further comprises a hollow upright support member affixed to the rearward edge of said base seating member of sufficient interior dimension to accept the lower end of said elongated resilient member within it in a male-female relationship.

4. An exercising device according to claim 3 wherein said hollow upright support member further contains means for affixing the lower end of said elongated resilient member at an adjustable vertical position relative to said base seating member within said hollow upright support member.

5. An exercising device according to claim 3 wherein the means for affixing the lower end of said elongated resilient member within said hollow upright support member further comprises a pin member, the elongated resilient member further defines a plurality of vertically spaced apertures sufficiently sized to accept said pin member, and the hollow upright support member further defines one or more apertures sufficiently sized to accept said pin member, corresponding to the vertical alignment of apertures defined by the elongated resilient member.

6. An exercising device according to claim 1, wherein said device further includes a lower back contact member affixed forward of the elongated resilient member.

7. An exercising device according to claim 3 wherein a lower back contact member is affixed to the hollow upright support member forward of said support member.

8. An exercising device comprising a base seating member having a forward edge and a rearward edge, an elongated resilient member having a lower end and an upper end, extending generally upwardly from the rearward edge of said base seating member, said lower end further defining a plurality of vertically spaced apertures, a hollow upright support member affixed to the rearward edge of said base seating member of sufficient dimension to accept the lower end of said elongated resilient member within it in a male-female relationship, said hollow upright support member further defining one or more apertures corresponding to the vertical alignment of apertures defined by the elongated resilient member, a pin suitably sized to penetrate the apertures defined by the hollow support member and elongated resilient member so as to adjustablely affix the elongated resilient member at an pre-determined distance above the base seating member, a lower back support member affixed forwardly of the hollow support member, an upper back support member affixed at the upper end of the elongated vertical member, and a handle bar assembly affixed to the upper end of said elongated resilient member opposite said upper back support member.

9. An exercising device according to claim 8, wherein said elongated resilient member is resistantly bowed, having a concave side and convex side.

10. An exercising device according to claim 8, wherein said elongated resilient member may be aligned within said hollow support member interchangeably so that either the upper back support member or the handlebar assembly is more proximate the forward edge of the seating member.

11. An exercising device according to claim 9, wherein the upper back support member is affixed to the concave side of the bowed resilient member and the handle bar assembly is affixed to the convex side of said bowed resilient member.

12. An exercising device according to claim 8, further comprising a plurality of interchangeable elongated resilient members, having varying degrees of resiliency.

13. An exercising device according to claim 8, wherein the upper and lower back support members further comprise a cushioning element.

14. An exercising device according to claim 8 wherein said handlebar assembly further comprises a primary bar member having a length dimension and a first end and second end; a pair of corresponding members forwardly extending from the first end and second end of said primary bar member; a pair of handle members each affixed to one of the forwardly extending members; a connecting member extending rearwardly from said primary bar member; and a means of affixing said connecting member to the elongated resilient member.

15. An exercising device according to claim 8, wherein said handlebar assembly is removeably affixed so that the same may be removed from the device when not in use.

16. An exercising device comprising:

a base seating member having a forward edge and a rearward edge, an elongated resilient member having a lower end and an upper end, extending generally upwardly from the rearward edge of said base seating member, a means for affixing the lower end of said elongated resilient member to the rearward edge of said base seating member, an upper back contact member affixed to the upper end of said elongated resilient member, and a lower back contact member affixed forward of the elongated resilient member, and including an elongated strap element having two end portions removably attached to each other and adjustable fastening means for closely fitting said strap element about the seating member and the legs of a person utilizing the device.

17. An exercising device comprising:

a base seating member having a forward edge and a rearward edge, an elongated resilient member having a lower end and an upper end, extending generally upwardly from the rearward edge of said base seating member, a means for affixing the lower end of said elongated resilient member to the rearward edge of said base seating member, comprising a hollow upright support member affixed to the rearward edge of said base seating member of sufficient interior dimension to accept the lower end of said elongated resilient member within it in a male-female relationship, wherein said hollow upright support member further contains means for affixing the lower end of said elongated resilient member at an adjustable vertical position relative to said base seating member within said hollow upright support member, an upper back contact member affixed to the upper end of said elongated resilient member, and a lower back contact member affixed to the hollow upright support member forward of said support member, and including an elongated strap element having two end portions removably attached to each other and adjustable fastening means for closely fitting said strap element about the seating member and the legs of a person utilizing the device.

18. An exercising device according to claim 8, including an elongated strap element having two end portions removably attached to each other and adjustable fastening means for closely fitting said strap element about the seating member and the legs of a person utilizing the device.

19. An exercising device comprising:

a base seating member having a forward edge and a rearward edge, an elongated resilient member having a lower end and an upper end, extending generally upwardly from the rearward edge of said base seating member, a means for affixing the lower end of said elongated resilient member to the rearward edge of said base seating member, an upper back contact member affixed to the upper end of said elongated resilient member, and wherein said resilient member provides a uniform resistence through an excursion of at least 30° from its static position.

20. An exercising device according to claim 1, wherein said resilient member provides a uniform resistence through an excursion of at least 30° from its static position.

21. An exercising device comprising a base seating member having a forward edge and a rearward edge, an elongated resilient member having a lower end and an upper end, extending generally upwardly from the rearward edge of said base seating member, said resilient member being bowed so as to provide a concave side and convex side, a means for affixing the lower end of said elongated resilient member to the rearward edge of said base seating member, and an upper back contact member affixed to the upper end of said elongated resilient member on the concave side thereof so as to be supported in a plane which is angled relative to the base seating member, and wherein said resilient member provides a uniform resistence through an excursion of at least 30° from its static position.

22. An exercising device comprising:

a base seating member having a forward edge and a rearward edge, an elongated resilient member having a lower end and an upper end, extending generally upwardly from the rearward edge of said base seating member, a means for affixing the lower end of said elongated resilient member to the rearward edge of said base seating member, an upper back contact member affixed to the upper end of said elongated resilient member, and wherein said resistence member provides a specified resistence within a range of 10 to 200 pounds of resistence.

23. An exercising device according to claim 1, wherein said resistence member provides a specified resistence within a range of 10 to 200 pounds of resistence.

24. An exercising device comprising a base seating member having a forward edge and a rearward edge, an elongated resilient member having a lower end and an upper end, extending generally upwardly from the rearward edge of said base seating member, said resilient member being bowed so as to provide a concave side and convex side, a means for affixing the lower end of said elongated resilient member to the rearward edge of said base seating member, and an upper back contact member affixed to the upper end of said elongated resilient member on the concave side thereof so as to be supported in a plane which is angled relative to the base seating member, wherein said resistence member provides a specified resistence within a range of 10 to 200 pounds of resistence.

* * * * *